US008240321B2

(12) United States Patent
Fountain et al.

(10) Patent No.: US 8,240,321 B2
(45) Date of Patent: Aug. 14, 2012

(54) MAGNETIC DRIVE CONTROLLED ROTATION FOR DISHWASHER SPRAY ARM

(75) Inventors: Jordan R. Fountain, Saint Joseph, MI (US); Sathish A. Sundaram, Benton Harbor, MI (US)

(73) Assignee: Whirlpool Corporation, Benton Harbror, MI (US)

( * ) Notice: Subject to any disclaimer, the term of this patent is extended or adjusted under 35 U.S.C. 154(b) by 348 days.

(21) Appl. No.: 12/641,400

(22) Filed: Dec. 18, 2009

(65) Prior Publication Data

US 2011/0146733 A1 Jun. 23, 2011

(51) Int. Cl.
*B08B 3/02* (2006.01)

(52) U.S. Cl. ..... 134/172; 134/181

(58) Field of Classification Search ..... 134/180, 134/181, 172

See application file for complete search history.

(56) References Cited

U.S. PATENT DOCUMENTS

| | | | | |
|---|---|---|---|---|
| 2,586,398 | A | 2/1952 | Vars | |
| 2,854,141 | A | 9/1958 | Barnstead | |
| 3,006,557 | A * | 10/1961 | Jacobs | 239/227 |
| 3,333,739 | A | 8/1967 | Clearman et al. | |
| 3,750,951 | A | 8/1973 | Perl | |
| 3,876,469 | A * | 4/1975 | Schimke | 134/95.2 |
| 4,913,346 | A * | 4/1990 | Nakamura et al. | 239/225.1 |
| 5,633,555 | A | 5/1997 | Ackermann et al. | |
| 5,651,380 | A | 7/1997 | Sargeant et al. | |
| 5,651,382 | A | 7/1997 | Sargeant et al. | |
| 5,673,716 | A | 10/1997 | Gurubatham et al. | |
| 5,675,318 | A * | 10/1997 | Hunt, Jr. | 340/540 |
| 5,709,237 | A | 1/1998 | Sargeant et al. | |
| 5,711,325 | A | 1/1998 | Kloss et al. | |
| 5,743,281 | A | 4/1998 | Sargeant et al. | |
| 7,100,623 | B2 | 9/2006 | Assmann et al. | |
| 7,111,796 | B2 * | 9/2006 | Olson | 239/452 |
| 2001/0017493 | A1 | 8/2001 | Sakamoto | |
| 2006/0162744 | A1 | 7/2006 | Walkden | |
| 2006/0237044 | A1 | 10/2006 | Ferguson et al. | |
| 2006/0249181 | A1 | 11/2006 | Wetzel et al. | |
| 2007/0186964 | A1 | 8/2007 | Mason et al. | |

FOREIGN PATENT DOCUMENTS

| | | | |
|---|---|---|---|
| DE | 3723721 | A1 | 5/1988 |
| DE | 4131914 | A1 | 4/1993 |
| EP | 0441756 | A1 | 8/1991 |
| EP | 0752231 | A1 | 1/1997 |
| EP | 0852928 | A2 | 7/1998 |
| EP | 1386575 | A1 | 2/2004 |
| GB | 2151464 | A | 7/1985 |
| JP | 02-198590 | * | 9/1990 |
| JP | 9066017 | A | 3/1997 |
| JP | 10-192217 | * | 7/1998 |
| JP | 2000-189372 | * | 7/2000 |

OTHER PUBLICATIONS

European Patent Office 0 084 342 Jul. 1983.*
European Patent Office 1 578 009 Sep. 2005.*
European Patent Office 1 671 572 Jun. 2006.*

* cited by examiner

*Primary Examiner* — Frankie L Stinson
(74) *Attorney, Agent, or Firm* — Jacquelyn R. Lin; McGarry Bair PC

(57) ABSTRACT

A motorized system drives rotation of a rotatable sprayer of a dishwasher. The drive system includes a magnetic coupler. The magnetic coupler includes a first portion that resides inside the wash chamber of the dishwasher, and a second portion that resides outside the wash chamber, such that the motor and the output shaft of the drive system are located entirely outside of the wash chamber.

16 Claims, 5 Drawing Sheets

MAGNETIC DRIVE CONTROLLED ROTATION FOR DISHWASHER SPRAY ARM

TECHNICAL FIELD

The present disclosure relates generally to automatic dishwashers, and more particularly to a magnetic system for driving rotation of one or more rotatable spray arms of an automatic dishwasher.

BACKGROUND

A dishwasher machine is an appliance into which dishes and other cooking and eating wares (e.g., plates, bowls, glasses, flatware, pots, pans, bowls, etcetera) are placed to be washed. During operation of the dishwasher, one or more rotatable spray arms direct wash liquid toward the wares. It is common for the spray arms to be rotated hydraulically by the acceleration of wash liquid from the dishwasher pump through the spray arm.

SUMMARY

According to one aspect, a dishwasher includes a tub. The tub defines a wash chamber. The tub includes a bottom wall. The bottom wall has an upper surface that faces the wash chamber and a lower surface that faces away from the wash chamber. The bottom wall also has formed therein a sump that extends downwardly from the upper surface of the bottom wall and a column that extends upwardly from the upper surface of the bottom wall.

The dishwasher also includes a number of dish racks movably positioned in the wash chamber, a sprayer located in the wash chamber, a machine compartment located outside of the tub, and a motor located in the machine compartment. A first magnetic coupler is located outside the wash chamber adjacent the lower surface of the column. The first magnetic coupler is coupled to and rotatably driven by the motor. A second magnetic coupler is located in the wash chamber adjacent the upper surface of the column. The second magnetic coupler is coupled to the sprayer and magnetically coupled to and rotatable with the first magnetic coupler such that rotation of the first magnetic coupler rotates the sprayer.

The first magnetic coupler and the second magnetic coupler may include one or more magnets of different polarities. The magnets of the first magnetic coupler may be radially spaced about the first magnetic coupler. The first magnetic coupler may have a wall extending downwardly from a top surface, and the magnets may be fixed to the wall. The wall may have an outer surface facing away from the upper surface of the column and an inner surface facing the upper surface of the column, and the magnet or magnets may be fixed to the inner surface of the wall. The wall may include one or more radially spaced fingers, where each magnet is fixed to the inner surface of one of the radially spaced fingers.

The dishwasher may include a transmission configured to transfer rotational energy from the first magnetic coupler to the sprayer and a drive shaft configured to transfer rotational energy from the motor to the second magnetic coupler. The second magnetic coupler may include a drive shaft extension coupled to the drive shaft and one or more radially spaced magnets fixed to the drive shaft extension and facing the lower surface of the column.

According to another aspect, a dishwasher includes a tub that defines a wash chamber. The tub includes a bottom wall. The bottom wall has an upper surface that faces the wash chamber and a lower surface that faces away from the wash chamber. The bottom wall also has formed therein a sump that extends downwardly from the upper surface of the bottom wall. Dish racks are movably positioned in the wash chamber. A rotatable sprayer is also located in the wash chamber. A first magnetic coupler is coupled to the sprayer such that rotation of the first magnetic coupler causes rotation of the sprayer.

A machine compartment is located outside the wash chamber. A pump is located in the machine compartment. The pump is fluidly coupled to the sprayer. A first motor is also located in the machine compartment. The first motor is operably coupled to the pump. A second motor is also located in the machine compartment. The second motor is operably coupled to the sprayer. A second magnetic coupler is coupled to the second motor. The second magnetic coupler is magnetically coupled to the first magnetic coupler such that rotation of the second magnetic coupler by the motor causes rotation of the first magnetic coupler.

A drive shaft may be coupled to the second motor, such that the second magnetic coupler is coupled to the drive shaft outside the wash chamber. The dishwasher may include a transmission located in the wash chamber, such that the transmission is coupled to the sprayer, and the first magnetic coupler is coupled to the transmission.

The first magnetic coupler may be positioned adjacent the upper surface of the bottom wall, and the second magnetic coupler may be positioned adjacent the lower surface of the bottom wall, where the bottom wall is a continuous wall. The upper surface of the bottom wall may be formed to include a recess, where the first magnetic coupler includes a finger that extends into the recess.

The first and second magnetic couplers may each include a plurality of radially spaced magnets. The magnets of the first magnetic coupler and the magnets of the second magnetic coupler may have opposite polarities. Also, the magnets of the first magnetic coupler may be spaced to align with the magnets of the second magnetic coupler.

According to another aspect, a dishwasher includes a tub. The tub defines a wash chamber. The tub includes a continuous wall having an upper surface that faces the wash chamber and a lower surface that faces away from the wash chamber. The wall has formed therein a sump that extends downwardly from the upper surface of the wall.

Dish racks are movably positioned in the wash chamber. A rotatable sprayer is also located in the wash chamber. A first magnetic coupler is coupled to the sprayer. The first magnetic coupler is located adjacent the upper surface of the wall.

A machine compartment is located outside the wash chamber. A pump is located in the machine compartment. The pump is in fluid communication with the sprayer. A motor is located in the machine compartment.

The dishwasher also includes a drive shaft. The drive shaft has a first end coupled to the motor and a second end spaced from the first end. A second magnetic coupler is coupled to the second end of the drive shaft adjacent the lower surface of the wall. The second magnetic coupler is magnetically coupled to the first magnetic coupler.

The first magnetic coupler may include a number of magnets each having a Curie temperature to withstand a temperature inside the wash chamber during operation of the dishwasher. The second magnetic coupler may include a number of magnets each having a size, shape and magnetic strength to magnetically transfer rotational energy from the motor to the sprayer during operation of the dishwasher. The magnets of the first magnetic coupler may have a first magnetic strength and the magnets of the second magnetic coupler may have a second magnetic strength, where the second magnetic strength is different than the first magnetic strength. The magnets of the first magnetic coupler may be substantially aligned with the magnets of the second magnetic coupler.

BRIEF DESCRIPTION OF THE DRAWINGS

The detailed description particularly refers to the following figures, in which.

DETAILED DESCRIPTION OF THE DRAWINGS

Figure 1:
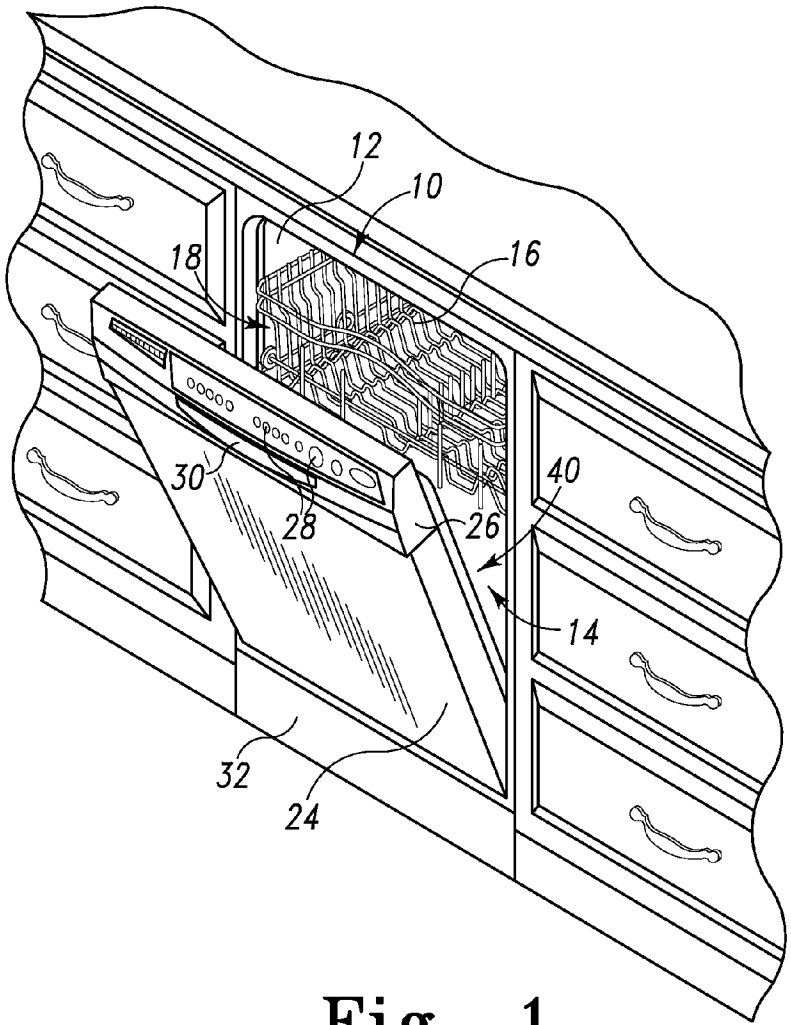
FIG. 1 is a fragmentary perspective view of a dishwasher installed in a kitchen cabinet.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Referring to FIG. 1, a dishwasher 10 is shown. The dishwasher 10 has a tub 12 that defines a wash chamber 14 into which a user may place dishes and other cooking and eating wares (e.g., plates, bowls, glasses, flatware, pots, pans, bowls, etc.) to be washed. The dishwasher 10 typically includes a number of racks 16 located in the tub 12, although only an upper rack is shown in FIG. 1. Roller assemblies 18 movably support the racks 16 in the wash chamber 14.

A door 24 is pivotably coupled to the tub 12. The door 24 permits user access to the wash chamber 14 to add detergent, load or unload the dishwasher 10, or to perform other tasks. A control panel 26 is supported by the door 24. The control panel 26 includes controls 28, such as buttons and knobs, which are actuatable to control the operation of the dishwasher 10. A handle 30 facilitates opening and closing of the door 24.

The dishwasher also has a machine compartment 32. The machine compartment 32 is typically located below the tub 12. The machine compartment 32 is sealed from the tub 12. In other words, unlike the tub 12, which fills with wash liquid and is exposed to spray during a wash cycle, the machine compartment 32 does not fill with wash liquid and is not exposed to spray during the operation of the dishwasher 10. The machine compartment 32 houses components such as the pump 34 and associated valves, wiring and plumbing.

While dishwasher 10 is illustrated as a conventional dishwashing unit, the features and aspects disclosed herein can also be implemented in other types of dishwashing units, such as in-sink dishwashers or drawer dishwashers.

Figure 2:
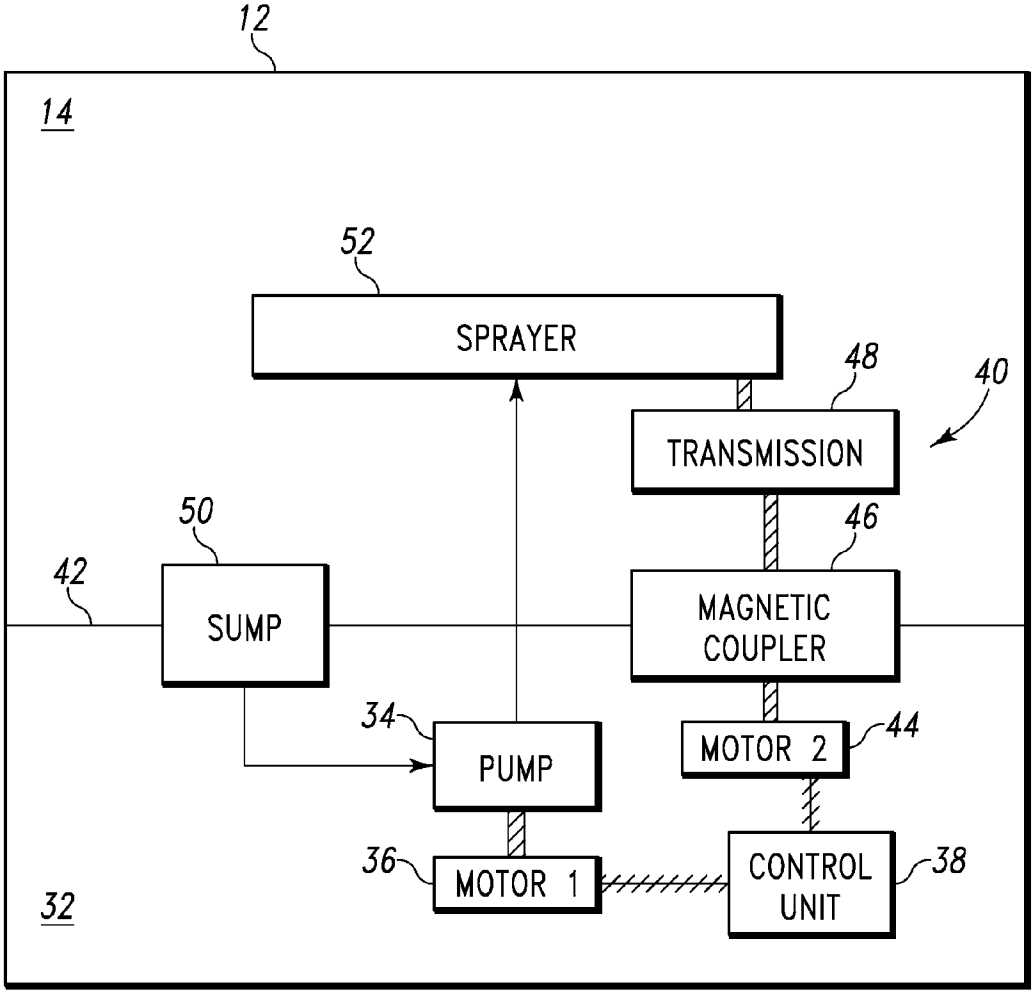
FIG. 2 is a schematic showing components of a sprayer system for a dishwasher.
Figure 3:
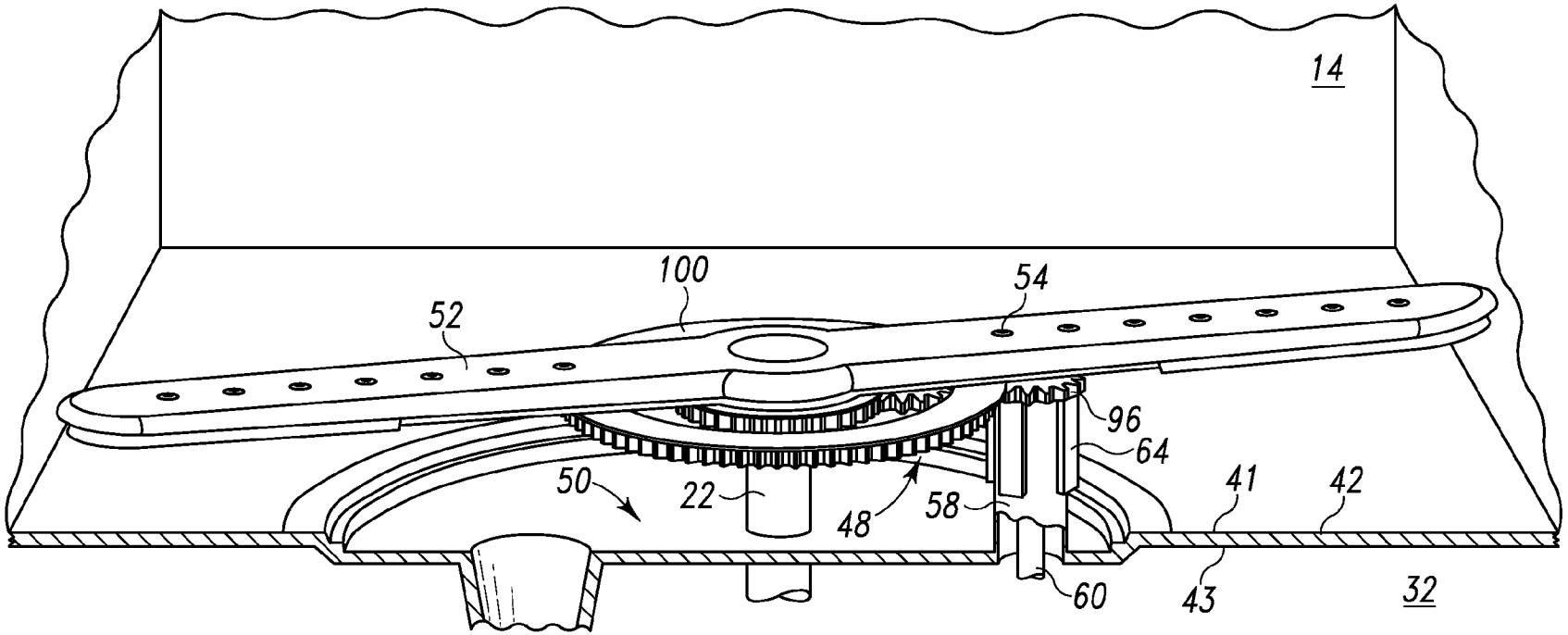
FIG. 3 is a fragmentary perspective view of an embodiment of the sprayer system of FIG. 2.

FIG. 2 schematically shows components of the tub 12 and the machine compartment 32 of the dishwasher 10. The bottom wall 42 of the tub 12 has a sump 50 formed (e.g. stamped) therein. The sump 50 defines a reservoir that extends downwardly in a direction away from the bottom wall 42 of the tub 12.

At the start of a wash cycle, wash liquid (i.e. water and detergent) enters the wash chamber 14 through an inlet (not shown). The wash liquid is typically directed toward the sump 50, by the force of gravity, for example. The pump 34 draws wash liquid from the sump 50. The pump 34 is driven by a motor 36 in response to control signals received by the motor 36 from a control unit 38.

The pump 34 is in fluid communication with at least one rotating sprayer 52 via a conduit 22. The conduit 22 directs wash liquid from the pump 34 to the sprayer 52. The sprayer 52 directs the wash liquid through outlets 54 toward the racks 16 (and hence any wares positioned thereon). Additional rotating sprayers or other spraying devices (not shown) may be provided in the wash chamber 14 and fluidly coupled to the pump 34.

Rotation of the sprayer 52 is powered by a sprayer drive system 40. The sprayer drive system 40 includes a motor 44, a magnetic coupler 46, and a transmission 48. Operation of the sprayer drive system 40 is controlled by the control unit 38.

The control unit 38 interprets electrical signals sent by user controls 28, or sensors or other components of the dishwasher 10, and activates and deactivates electronically-controlled components of the dishwasher 10. For example, the control unit 38 electronically controls operation of the motor 36 (and hence, the pump 34), as well as the motor 44 (and hence, the sprayer 52). In other embodiments, each of the motors 36, 44, may be controlled by separate control units.

As will be understood by those skilled in the art, the control unit 38 may comprise analog and/or digital circuitry to process electrical signals received from the components of the dishwasher 10 and provide electrical control signals to components of the dishwasher 10. For example, the control unit 38 may comprise one or more microcontrollers that execute firmware routines to control the operation of the dishwasher 10.

In operation, torque output by the motor 44 of the sprayer drive system 40 rotates a drive shaft 60. The magnetic coupler 46 transfers the rotational energy produced by the motor 44 to the transmission 48. The transmission 48 is located in the wash chamber 14. The transmission 48 cooperates with the conduit 22 to rotate the sprayer 52 while wash liquid flows through the conduit 22 to the sprayer 52. In this way, the hydraulic power of the wash liquid can be directed entirely to cleaning, while the sprayer drive system 40 powers the rotation of the sprayer 52.

The magnetic coupler 46 includes a motor coupler 62 and a sprayer coupler 64, each positioned adjacent the bottom wall 42 of the tub 12. The bottom wall 42 of the tub 12 has an upper surface 41 and a lower surface 43. The upper surface 41 faces the wash chamber 14 and the lower surface 43 faces away from the wash chamber 14. The sprayer coupler 64 is positioned adjacent the upper surface 41 and the motor coupler 62 is positioned adjacent the lower surface 43 of the bottom wall 42.

In the illustrated embodiment, a column 58 is formed in the bottom wall 42. The column 58 extends upwardly from the sump 50. The column 58 is continuous and integral with the bottom wall 42, such that there are no leak points along the column 58 or along its boundary with the bottom wall 42.

Figure 4:
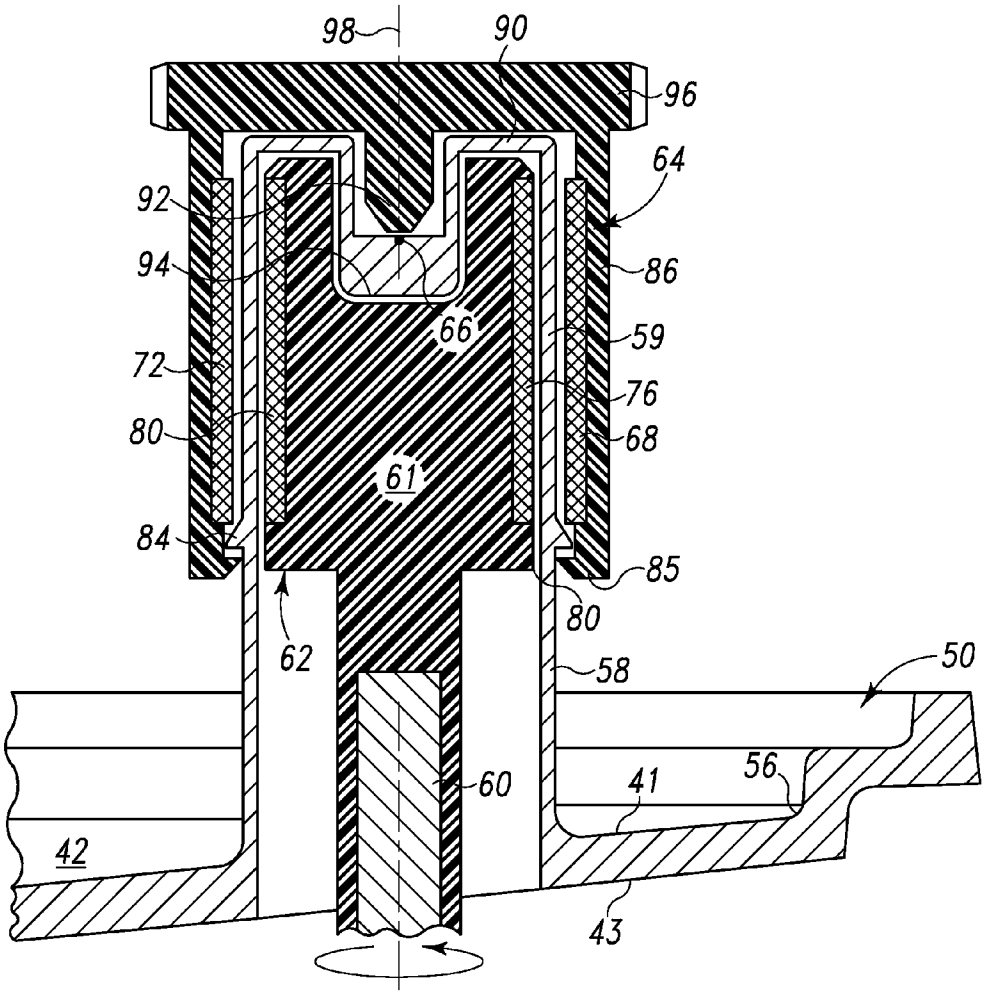
FIG. 4 is a longitudinal cross-sectional view of an embodiment of a magnetic coupler for the sprayer system of FIG. 2.

As best shown in FIG. 4, the sprayer coupler 64 is positioned adjacent the upper surface 41 of the column 58 (in the wash chamber 14), while the motor coupler 62 is positioned adjacent the lower surface 43 of the column 58 (outside the wash chamber 14). The sprayer coupler 64 is substantially cylindrical or sleeve-shaped and fits over a top portion 90 of the column 58.

The sprayer coupler 64 has a pivot coupler 92 that is positioned adjacent the pivot point 66 of the column 58. The pivot coupler 92, and thus the sprayer coupler 64, rotates about the pivot point 66. In the illustrated embodiment, the pivot coupler 92 is defined by a substantially finger-like structure, and the pivot point 66 is located in a recess of the column 58, such that the pivot coupler 92 extends downwardly into the recess toward the pivot point 66. The motor coupler 62 has a similar recess that substantially follows the contour of the recess of the column 58.

In other embodiments, the pivot coupler 92 is defined by a recess rather than a finger-like structure, and the top portion 90 of the column 58 extends substantially upwardly into the recess of the pivot coupler 92 at the pivot point 66. The motor coupler 62 is shaped in accordance with the contour of the top portion 90 of the column 58. In general, the couplers 62, 64 of the magnetic coupler 46 are in spaced relation to the column 58 and are sized, shaped, and spaced to rotate about the vertical axis 98 relative to the column 58.

The sprayer coupler 64 has a wall 86 that is positioned adjacent and spaced from the wall 59 of the column 58. In the illustrated embodiment, the walls 59, 86 are substantially cylindrical. The wall 86 comprises a number of radially spaced downwardly extending fingers, each of which houses a magnet 68, 79, 72, 74, and each of which has a lip 85. A stop 84 projects outwardly from the wall 59 of the column 58, adjacent the lip 85 of the sprayer coupler 64. The stop 84 helps prevent disengagement of the sprayer coupler 64 from the column 58 during rotation of the sprayer coupler 64. The stop 84 also helps maintain vertical alignment of the magnets 68, 70, 72, 74, 76, 78, 80, 82 during rotation of the magnetic coupler 46.

An output device 96 is coupled to the top of the sprayer coupler 64. The output device 96 transfers rotational energy to the transmission 48. In the illustrated embodiment, the output device 96 is an integrated gear that intermeshes with a gear 100 of the transmission 48. However, any suitable apparatus for transferring rotational energy from the sprayer coupler 64 to the sprayer 52, including gears, pulleys, and/or belts, may be used. As will be appreciated by those skilled in the art, shields (not shown) may be used to protect one or more of such components from the chemistry of the wash liquid and/or to prevent accumulation thereon of food, soil, carbonates or the like.

The sprayer coupler 64 is magnetically coupled to the motor coupler 62 such that the sprayer coupler 64 rotates with the drive shaft 60. The column 58 of the tub 12 separates the wash chamber 14 from the machine compartment 32, and thus the wall 59 is interposed between the sprayer coupler 64 and the motor coupler 62.

Figure 5:
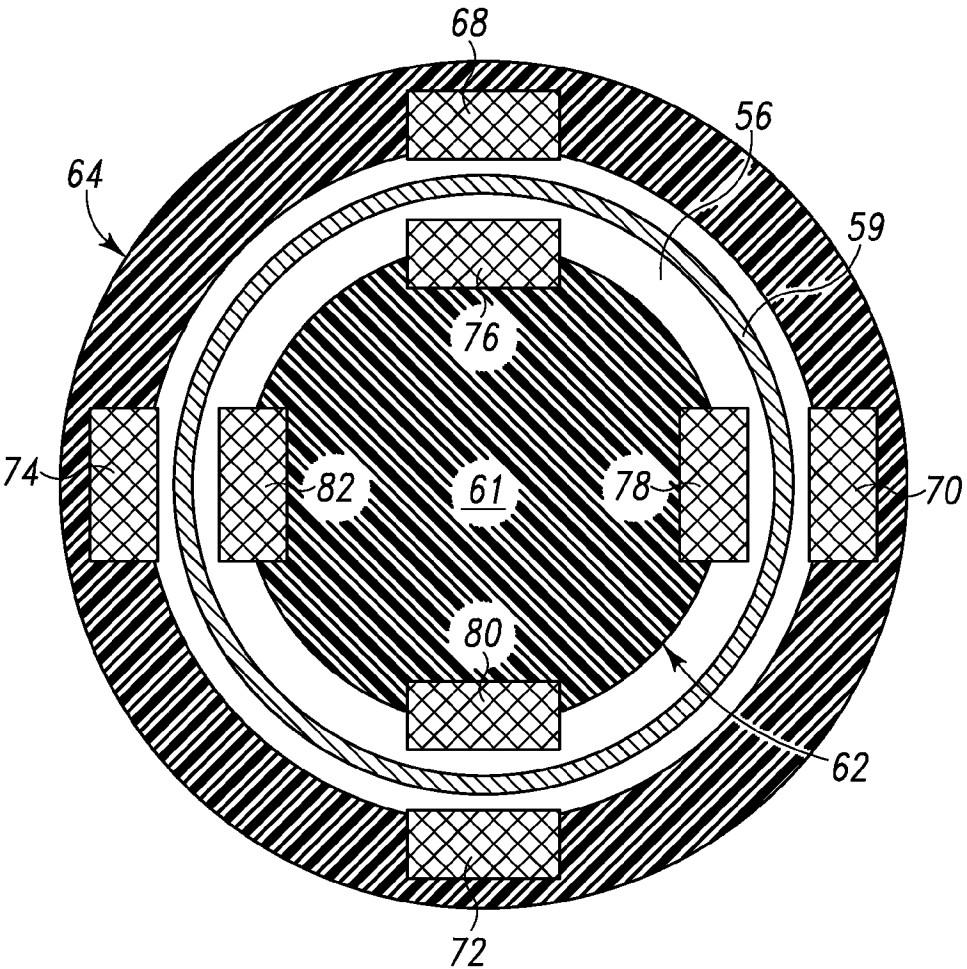
FIG. 5 is a simplified lateral cross-sectional view of the magnetic coupler of FIG. 4.

The motor coupler 62 includes the drive shaft 60 and a drive shaft extension 61 as shown in FIG. 4. The drive shaft extension 61 includes a number of radially spaced seats, each of which retains a magnet 76, 78, 80, 82 as shown in FIG. 5.

As noted above, both the sprayer coupler 64 and the motor coupler 62 include at least one magnet or other magnetic field generator. In the illustrated embodiment, the sprayer coupler 64 includes four magnets 68, 70, 72, 74 disposed at spaced locations about the wall 86, and the motor coupler 62 includes four magnets 76, 78, 80, 82 disposed at spaced locations about the drive shaft extension 61.

The magnets are arranged to avoid cancellation of magnetic field strengths. For example, the magnets 68, 70, 72, 74 all have the same polarity. The magnets 76, 78, 80, 82 have the opposite polarity as the magnets 68, 70, 72, 74, so as to create a magnetic coupling between the sprayer coupler 64 and the motor coupler 62. The magnets 68, 70, 72, 74 are spaced from the magnets 76, 78, 80, 82 by the thickness of the wall 59 plus sufficient distance on either side of the wall 59 to permit free rotation of the motor coupler 62 and the sprayer coupler 64 relative to the column 58.

The number of magnets used in the couplers 62, 64, and their size, shape, arrangement and other characteristics are configurable. Close proximity of the magnets 68, 70, 72, 74 to the magnets 76, 78, 80, 82 generally increases the efficiency of the power transfer from the motor 44 to the sprayer 52.

The illustrated embodiment uses eight block magnets having dimensions in the range of about 1"×¼"×1/16". However, magnets having larger or smaller size, or a curved, cylindrical, square, or other suitable shape, may also be used. The magnets 68, 70, 72, 74 may be molded (i.e. injection or blow-molded) into the wall 86 of the sprayer coupler 64 to shield them from exposure to wash liquid and soils. The magnets 68, 70, 72, 74 may alternatively be affixed to the wall 86 by epoxy or suitable adhesive. Similarly, the magnets 76, 78, 80, 82 may be affixed to the drive shaft extension 61 by epoxy or suitable adhesive.

The magnets 68, 70, 72, 74, 76, 78, 80, 82 are of the rare earth neodymium type, or other type of strong magnet. The magnetic strength and/or gauss rating may be selected as required depending on the size, number, and complexity of sprayer or sprayers 52 to be driven thereby. In the illustrated embodiment, the magnets 68, 70, 72, 74, 76, 78, 80, 82 are configured to have a gauss rating in the range of 13,300 G and/or an approximate pull force in the range of about 3.9 pounds.

Characteristics of the magnets 68, 70, 72, 74, 76, 78, 80, 82 may also be selected to provide an amount of rotational slip (i.e., a "slip clutch" effect), which may be desirable in the event that the sprayer 52 encounters an obstacle during rotation, for example. Slip between the sprayer coupler 64 and the motor coupler 62 allows the magnetic coupler 46 to react to abrupt changes in movement of the sprayer 52 without causing damage to either the sprayer 52 or the motor 44.

The Curie rating of the magnets 68, 70, 72, 74 may be selected as required to withstand internal temperatures of the wash chamber 14 during operation of the dishwasher 10.

The motor 44 may be any suitable electric motor, such as an AC, DC, stepper, or servo motor. A motor with a gear reduction may be used if increased torque is desired. The sprayer coupler 52 and other solid components are typically made of a molded poly, such as a polypropelene, polyethelene, polycarbonate or the like. Belts, if any, used to transfer rotational energy from the magnetic coupler 46 to the sprayer 52 are typically made of a silicone or BUNA-N material, or other material capable of withstanding the temperature, chemistry and volume of wash liquid in the wash chamber 14.

There are many advantages of the present disclosure arising from the various features described herein. It will be noted that alternative embodiments of the present disclosure may not include all of the features described yet still benefit from at least some of the advantages of such features. Those of ordinary skill in the art may readily devise their own implementations of the method, apparatus, and system that incorporate one or more of the features of the present invention and fall within the spirit and scope of the present disclosure as defined by the appended claims.

The invention claimed is:

1. A dishwasher, comprising:

a tub defining a wash chamber, the tub comprising a bottom wall having an upper surface that faces the wash chamber and a lower surface that faces away from the wash chamber, wherein the bottom wall has formed therein a sump that extends downwardly from the upper surface of the bottom wall and a column that extends upwardly from the upper surface of the bottom wall, at least one dish rack movably positioned in the wash chamber, a sprayer located in the wash chamber, a machine compartment located outside of the tub, a motor located in the machine compartment, a first magnetic coupler located outside the wash chamber adjacent the lower surface of the column, the first magnetic coupler being coupled to and rotatably driven by the motor wherein the first magnetic coupler includes at least one first magnet, a top surface, and a wall extending downwardly from the top surface and the wall has an outer surface facing away from the upper surface of the column and an inner surface facing the upper surface of the column, and the at least one first magnet is fixed to the inner surface of the wall, and a second magnetic coupler located in the wash chamber adjacent the upper surface of the column, the second magnetic coupler being coupled to the sprayer and magnetically coupled to and rotatable with the first magnetic coupler such that rotation of the first magnetic coupler rotates the sprayer.

2. The dishwasher of claim 1, wherein the second magnetic coupler comprises at least one second magnet, the at least one first magnet has a first polarity, the at least one second magnet has a second polarity, and the second polarity is opposite the first polarity.

3. The dishwasher of claim 2, wherein the at least one first magnet comprises a first plurality of radially spaced magnets.

4. The dishwasher of claim 3, wherein the wall comprises a plurality of radially spaced fingers and each magnet is fixed to the inner surface of one of the radially spaced fingers.

5. The dishwasher of claim 4, comprising a transmission configured to transfer rotational energy from the first magnetic coupler to the sprayer and a drive shaft configured to transfer rotational energy from the motor to the second magnetic coupler.

6. The dishwasher of claim 5, wherein the second magnetic coupler comprises a drive shaft extension coupled to the drive shaft and a second plurality of radially spaced magnets fixed to the drive shaft extension and facing the lower surface of the column.

7. The dishwasher of claim 1, wherein the first magnetic coupler comprises a number of magnets each having a Curie temperature to withstand a temperature inside the wash chamber during operation of the dishwasher.

8. The dishwasher of claim 7, wherein the second magnetic coupler comprises a number of magnets each having a size, shape and magnetic strength to magnetically transfer rotational energy from the motor to the sprayer during operation of the dishwasher.

9. The dishwasher of claim 8, wherein the magnets of the first magnetic coupler have a first magnetic strength and the magnets of the second magnetic coupler have a second magnetic strength different than the first magnetic strength.

10. The dishwasher of claim 9, wherein the magnets of the first magnetic coupler are substantially aligned with the magnets of the second magnetic coupler.

11. A dishwasher, comprising:

a tub defining a wash chamber, the tub comprising a bottom wall having an upper surface that faces the wash chamber and a lower surface that faces away from the wash chamber, wherein the bottom wall has formed therein a sump that extends downwardly from the upper surface of the bottom wall, at least one dish rack movably positioned in the wash chamber, a rotatable sprayer located in the wash chamber, a first magnetic coupler coupled to the sprayer such that rotation of the first magnetic coupler causes rotation of the sprayer, a machine compartment located outside the wash chamber, a pump located in the machine compartment and fluidly coupled to the sprayer, a first motor located in the machine compartment and operably coupled to the pump, a second motor located in the machine compartment, a second magnetic coupler operably coupled to the second motor, the second magnetic coupler being magnetically coupled to the first magnetic coupler such that rotation of the second magnetic coupler by the motor causes rotation of the first magnetic coupler, and a transmission located in the wash chamber, the transmission being coupled to the sprayer, wherein the first magnetic coupler is coupled to the transmission.

12. The dishwasher of claim 11, comprising a drive shaft coupled to the second motor, wherein the second magnetic coupler is coupled to the drive shaft outside the wash chamber.

13. The dishwasher of claim 11, wherein the first magnetic coupler is positioned adjacent the upper surface of the bottom wall and the second magnetic coupler is positioned adjacent the lower surface of the bottom wall, and the bottom wall is a continuous wall.

14. The dishwasher of claim 13, wherein the upper surface of the bottom wall is formed to include a recess, and the first magnetic coupler comprises a finger that extends into the recess.

15. The dishwasher of claim 14, wherein each of the first and second magnetic couplers comprises a plurality of radially spaced magnets.

16. The dishwasher of claim 15, wherein the magnets of the first magnetic coupler have a first polarity, the magnets of the second magnetic coupler have a second polarity opposite the first polarity, and the magnets of the first magnetic coupler are spaced to align with the magnets of the second magnetic coupler.

* * * * *